US008192634B2

(12) United States Patent
Gilles

(10) Patent No.: US 8,192,634 B2
(45) Date of Patent: Jun. 5, 2012

(54) CENTRIFUGAL BASKET ASSEMBLY WITH SEGMENTED DAM AND METHOD

(76) Inventor: Stephen R. Gilles, Elberfeld, IN (US)

( * ) Notice: Subject to any disclaimer, the term of this patent is extended or adjusted under 35 U.S.C. 154(b) by 456 days.

(21) Appl. No.: 12/460,063

(22) Filed: Jul. 13, 2009

(65) Prior Publication Data

US 2011/0006016 A1 Jan. 13, 2011

(51) Int. Cl.
*B04B 3/00* (2006.01)
*B04B 7/18* (2006.01)

(52) U.S. Cl. ..... 210/781; 210/232; 210/360.1; 210/380.1

(58) Field of Classification Search ..... 210/781, 210/232, 360.1, 380.1
See application file for complete search history.

(56) References Cited

U.S. PATENT DOCUMENTS

| | | | | |
|---|---|---|---|---|
| 1,592,717 | A | | 7/1926 | Breneman |
| 1,643,441 | A | | 9/1927 | Blanchard |
| 2,321,207 | A | | 6/1943 | Howe |
| 2,998,137 | A | | 8/1961 | Vane |
| 3,390,777 | A | | 7/1968 | Grieselhuber |
| 3,425,561 | A | | 2/1969 | Steele et al. |
| 3,799,353 | A | | 3/1974 | Pause |
| 3,946,940 | A | | 3/1976 | Takodoro |
| 4,170,344 | A | | 10/1979 | Megerle et al. |
| 4,922,625 | A | | 5/1990 | Farmer |
| 4,961,722 | A | | 10/1990 | Taylor et al. |
| 5,125,166 | A | | 6/1992 | Farmer |
| 5,330,637 | A | | 7/1994 | Nemedi |
| 5,378,364 | A | * | 1/1995 | Welling ..... 210/512.1 |
| 5,458,776 | A | | 10/1995 | Preisser et al. |
| 5,788,861 | A | | 8/1998 | Serenkin |
| 5,855,800 | A | | 1/1999 | Serenkin |
| 6,244,446 | B1 | | 6/2001 | Schmittel |
| 6,579,458 | B2 | | 6/2003 | Mickelat et al. |
| 6,761,821 | B2 | | 7/2004 | Appel et al. |
| 7,140,494 | B2 | | 11/2006 | Fujimoto et al. |
| 7,335,302 | B2 | | 2/2008 | Bartsch et al. |
| 7,425,264 | B2 | | 9/2008 | Reig |
| 2006/0021931 | A1 | | 2/2006 | Reig |
| 2006/0151377 | A1 | | 7/2006 | Fujimoto et al. |
| 2008/0289208 | A1 | | 11/2008 | Bryan |

* cited by examiner

*Primary Examiner* — David A Reifsnyder
(74) *Attorney, Agent, or Firm* — Meroni + Meroni, P.C.; Charles F. Meroni, Jr.; Christopher J. Scott

(57) ABSTRACT

The separator screen arrangement of a centrifugal basket assembly reduces separator screen wear and eases structural replacement of worn parts. The centrifugal basket assembly comprises a screen-supporting basket; a separator screen, and a series of J-shaped dam segments. The separator screen is received and supported by the basket and comprises and inlet and a circular outlet end. The dam segments each comprise a dam portion, and a rim seat portion. The rim seat portions seat upon the rim, being attached thereto in a circular manner side-by-side such that the dam portions extend toward the inlet end. The dam portions dam material directed thereagainst from the inlet end so as to uniformly spread and layer material upon the separator screen before the material exits the basket assembly. The uniformly spread and layered material reduces wear of the separator screen. Material-drying and screen-protecting methodology is further supported by the basket assembly.

12 Claims, 9 Drawing Sheets

CENTRIFUGAL BASKET ASSEMBLY WITH SEGMENTED DAM AND METHOD

BACKGROUND OF THE INVENTION

1. Field of the Invention

The present invention generally relates to a centrifugal basket assembly and certain material-drying and screen-protecting methods enabled thereby. More particularly, the present invention relates to a centrifugal basket assembly with segmented dam feature for retarding and/or preventing separator screen wear and tear.

2. Discussion of Prior Art

Centrifugal drying assemblies are well developed and known in a number of relevant arts. With regard to centrifugal dryers for drying solid materials such as coal and the like, the centrifugal drying assemblies are more specifically tailored to meet the demands of the matter to be dried. U.S. Pat. No. 4,922,625 ('625 patent), which issued to Farmer, for example, discloses a Sectionalized Centrifugal Drying Basket/Screen Assembly, which assembly is specifically constructed to minimize wear.

In this last regard, the '625 patent describes a sectionalized screen/basket assembly for a centrifugal dryer for coal slurry comprising a screen formed in an upper section and a lower section, enabling one to save substantially on screen replacement costs, inasmuch as the great preponderance of screen wear in such dryers is at the top of the screen, at the point of slurry introduction. An internal circumferential ridge on the upper screen creates a particle cake that further reduces wear.

Further, U.S. Pat. No. 4,961,722 ('722 patent), which issued to Taylor et al., discloses a Conical Screen for a Vertical Centrifugal Separator. The '722 patent describes an improved vertical centrifugal separator of the type used to dry coal, which improvement is provided by splitting a frustoconical screen into two pieces and including access doors in the water shield surrounding the screen. The division of the screen is made horizontally, for example at a level of about 30 to 70 percent down from the top of the screen.

This permits the separator to be serviced in a relatively short time, by replacing only the upper partial screen when holes are worn in it. This is feasible because most of the wear in these screens is confined to about the upper 30 percent of their height. If a screen support basket is used, it can be confine to the lower partial screen, so that it does not have to be removed in order to replace the upper partial screen.

It will thus be seen from a review of the '625 patent and '722 patents that centrifugal dryers used for drying coal slurry are subject to wear and tear. The present invention addresses this common adverse side effect in centrifugal dryers by implementing a damming feature at the discharge end of the centrifugal drying assembly. Some of the more pertinent art relating to, or bearing on centrifugal dryer assemblies arguably incorporating a damming or dam-like feature are briefly described hereinafter.

U.S. Pat. No. 3,390,777 ('777 patent), which issued to Grieselhumber, discloses a Feed-Straining Continuous Basket with Trash Trapping Means. The '777 patent describes a centrifugal filter basket having a feed accelerating cup at the bottom thereof for receiving the feed and a trash trapping ring attached to the cup to remove trash from feed passing from the cup to the filter. Arguably, the trash trapping ring could be analogized to resemble a dam type flange.

U.S. Pat. No. 3,946,940 ('940 patent), which issued to Tadokoro, discloses a Centrifugal Basket. The '940 patent describes a basket for a centrifugal separator which has a rotatable shell having at least one flange formed at one end thereof for containing liquid, an exchangeable flat ring having a number of holes radially formed therethrough with respect to the center axis of said shell and removably mounted to the flange of said shell for discharging liquid contained in said shell, and a plurality of circular cover for coating one end surface of said exchangeable ring. Since the basket is thus constructed, it is adapted for high speed rotation.

U.S. Pat. No. 5,458,776 ('776 patent), which issued to Preisser et al., discloses a Sand Dewatering Centrifuge. The '776 patent describes a centrifuge for dewatering a fluent aggregate material such as sand. Sand slurry is conducted into a rotating cylindrical drum which has a perforated lateral wall against which a screen is placed. The drum is oriented with the axis disposed vertically. When the centrifuge operates, centrifugal action slings slurry poured into the drum outwardly. Upon contacting the lateral wall, the slurry builds up. When a certain quantity of the slurry has built up at the bottom or floor of the cylinder, additional material cannot resist migrating upwardly.

Thickness of the trapped layer varies, being greater at the floor, near the source of the incoming slurry. This trapped layer forms a bed having an inclined wall. Thickness of the bed at the top of the cylinder is determined by a circumferential, inwardly projecting flange or dam located at the top of the cylindrical drum. The sand bed protects metal parts of the centrifuge from abrasion, and also enables water to diffuse therethrough. Water is discharged through perforations in the lateral wall, and dewatered sand continues to migrate upwardly. At the top of the drum, this sand migrates beyond the flange, and is slung outwardly against a shroud, which directs the sand to an outer conveyor or chute therebelow. This shroud includes an internal shelf which traps a layer of sand protecting the shroud from erosion by sand ejected from the drum. Water is trapped by a second shroud, and is collected at a suitable discharge chute or conduit.

U.S. Pat. No. 6,244,446 ('446 patent), which issued to Schmittal, discloses a Method and Apparatus for Continuously Separating a More Dense Fraction from a Less Dense Fraction of a Pulp Material. The '446 patent describes a method and centrifugal separator apparatus for separating more dense particles from less dense particles contained in a slurry. The separator apparatus receives slurry into a rotor assembly which includes a bowl open upwardly and a surrounding hutch chamber. The bowl has a lower impermeable portion coupled to a drive shaft for rotating the rotor assembly, an upper impermeable portion connected to the lower portion, and a frusto-conical screen.

The frusto-conical screen forms the inner wall of the hutch chamber and discharge outlets are provided in the periphery of the hutch chamber. An annular fluid inlet connected to the hutch chamber supplies elutriation liquid continuously to the interior of the hutch chamber, and a plurality of pulse blocks supply intermittent pulses of liquid to the hutch chamber. A dam is formed at the top of the screen. In operation, slurry is supplied to the lower portion of the bowl and forms a bed on the screen.

A continuous flow of liquid is supplied axially inwardly from the hutch chamber through the screen and slurry bed. Liquid is also lightly pulsed from the hutch chamber axially inwardly through the screen and slurry bed. Under centrifugal, gravitational and liquid flow forces the denser particles migrate toward and through the screen and lighter particles migrate inwardly toward the axis of rotation. The denser particles pass through the screen into the hutch chamber and are collected on exiting from the discharge outlets. The lighter particles are carried over the dam and are collected separately.

U.S. Pat. No. 7,140,494 ('494 patent) and United States Patent Application Publication No. 2006/0151377, which were authored by Fujimoto et al., disclose certain Centrifugal Machines comprising a screen bowl type centrifugal separator which can not only eliminate the problem of the productivity being lowered resulting from the occurrence of clogging with the crystals in the screen part, but also minimize the amount of leakage of the object to be treated in the screen part.

Inside of the hub of the screw conveyor, a cleaning liquid receiving part which receives the cleaning liquid for the cleaning nozzle is provided, and further, in the cleaning liquid receiving part, a residual layer crystal cleaning liquid receiving part which receives the cleaning liquid for cleaning the residual layer object to be treated in the screen part is provided, being partitioned independently of the inside of the cleaning liquid receiving part.

The cleaning liquid which has been supplied to the inside of the residual layer crystal cleaning liquid receiving part is jet spouted directly toward the residual layer object to be treated from the outer circumferential edge of the flight through the residual layer crystal cleaning liquid path provided along the direction of the helix of the flight, with no relation to said cleaning liquid receiving part.

U.S. Pat. No. 7,425,264 ('264 patent), which issued to Reig, discloses a Centrifugal Screen. The '264 patent describes a centrifuge which has a truncated-cone-like separating screen arranged in support basket and held in the bottom thereof by lower flange. The lower flange has notched surface which penetrates into the screen. The screen and the basket both have an annular upper edge and an upper flange which is attached to the upper edge of the basket and covers the upper edge of the screen. Finally, the screen is formed by a number of segments attached in pairs by a joint with a T-shaped section.

From a review of the above-referenced patents and other prior art generally known to exist that the prior art does not teach a damming feature for a centrifugal basket assembly, which damming feature comprises an annular ring of separate dam segments or dam hooks outfitted upon the rim of the separator screen. A plurality of side-by-side dam segments arranged annularly about the rim periphery of the screen rim and arranged so as to eliminate gaps therebetween is unknown heretofore in the pertinent art. The prior art thus perceives a need for such an arrangement, as described in more detail hereinafter.

SUMMARY OF THE INVENTION

In conventional centrifugal drying systems, solids and liquids are introduced or otherwise directed into an inlet end of a centrifuge through a feed chute or similar other mechanism. The introduced materials are then distributed to the screen portion of the centrifuge basket. Material contacts the accelerator bars that convey material toward the discharge end of the baking making room for more material to enter the apparatus. As material progresses toward the discharge end of the basket, its velocity increases due to the (generally) frustoconical shape of the basket and the rotational velocity.

As velocity increases, material contact with the screen surface becomes ever more problematic. Accordingly, the separator screen is worn away at an accelerated rate. The ability to control or otherwise interfere with material impact upon the separator screen thus becomes critical to avoid having to replace costly separator screens. It has been found that providing a dam at the discharge end of the basket dams a first layer of material upon the screen thereby more evenly spreading the material upon the screen surface thereby providing a protective barrier for secondary layers of material. This damming action thus retards screen wear.

The segmented dam feature according to the present invention provides for additional cost savings by enabling the system to function with easily replaced, and inexpensive dam segments rather than relatively more costly, integrally annular flanges or dams outfitted upon the centrifugal basket assembly. The present invention preferably incorporates (brittle) ceramic dam segments or hooks, which can be easily removed or replaced by impacting or breaking the material clear of the separator screen and reattaching a replacement segment on an "as needed" basis.

BRIEF DESCRIPTION OF THE DRAWINGS

Other features of my invention will become more evident from a consideration of the following brief descriptions of the patent drawings accompanying this specification:

FIG. 2(*b*) is a top view of material first being introduced into the spinning basket assembly otherwise depicted in FIG. 2(*a*), which material is beginning to make contact with the annularly arranged dam segments.

FIG. 2(*c*) is a top view of material having been introduced into the spinning basket assembly otherwise depicted in FIG. 2(*a*), which material has been dammed by the annularly arranged dam segments.

FIG. 3(*b*) is a fragmentary enlarged perspective view of a portion of the separator screen of the centrifugal basket assembly according to the present invention showing a series of five dam segments as arranged in side-by-side relation upon the rim of the separator screen.

FIG. 4(*b*) is a diagrammatic depiction of a generic hammer head impact-breaking a dam segment for removal and replacement.

FIG. 4(*c*) is a diagrammatic depiction of a replacement dam segment being adhesively attached to the separator screen rim.

FIG. 5(*b*) is as an enlarged fragmentary view of the gap between the outer channel portion and outer arc length portion otherwise depicted in FIG. 5(*a*).

FIG. 5(*c*) is as an enlarged fragmentary view of the gap between the inner channel portion and left most inner arc length portion otherwise depicted in FIG. 5(*a*).

FIG. 5(*d*) is as an enlarged fragmentary view of the gap between the inner channel portion and right most inner arc length portion otherwise depicted in FIG. 5(*a*).

DETAILED DESCRIPTION OF THE PREFERRED EMBODIMENT AND METHOD

Figure 1:
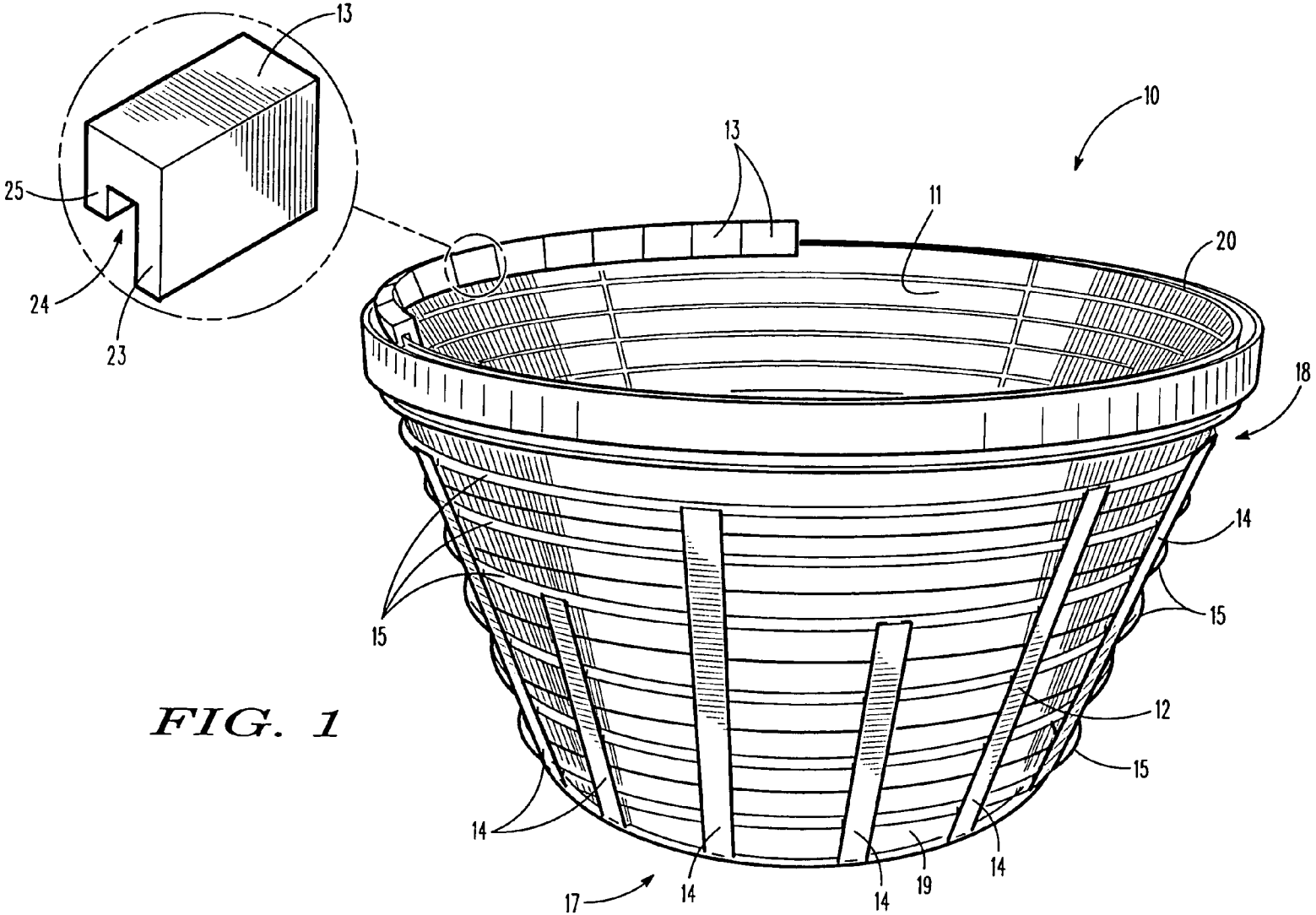
FIG. 1 is a top perspective view of a centrifugal basket assembly according to the present invention showing a first series of dam segments arranged in side-by-side relation upon the separator screen rim of the basket assembly, the series of dam segments forming an arc length of an otherwise complete circle, and a single dam segment being exploded and shown in enlarged perspective.

Referring now to the drawings with more specificity, the present invention concerns a centrifugal basket assembly 10 and/or separator screen arrangement for use with a centrifugal dryer, which basket assembly 10 or separator screen arrangement is designed to retard and/or reduce wear of a separator screen 11 made part of the basket assembly 10. The centrifugal basket assembly 10 according to the present invention preferably comprises a frustoconically-shaped, screen-retaining or screen-supporting basket as at 12; a frustoconically-shaped separator screen as at 11; and a series of J-shaped or hook-shaped dam segments as at 13.

The basket 12, preferably constructed from steel, essentially provides a frusto-conically framework for receiving and supporting the separator screen 11. The framework may preferably comprise linearly extending fins as at 14 and a series of transversely extending circular rings as at 15, which fins 14 and rings 15 may be welded to another to form the basket 12, which basket has an inlet basket end as at 17 and an outlet basket end as at 18.

Figures 4A, 4B, 4C:
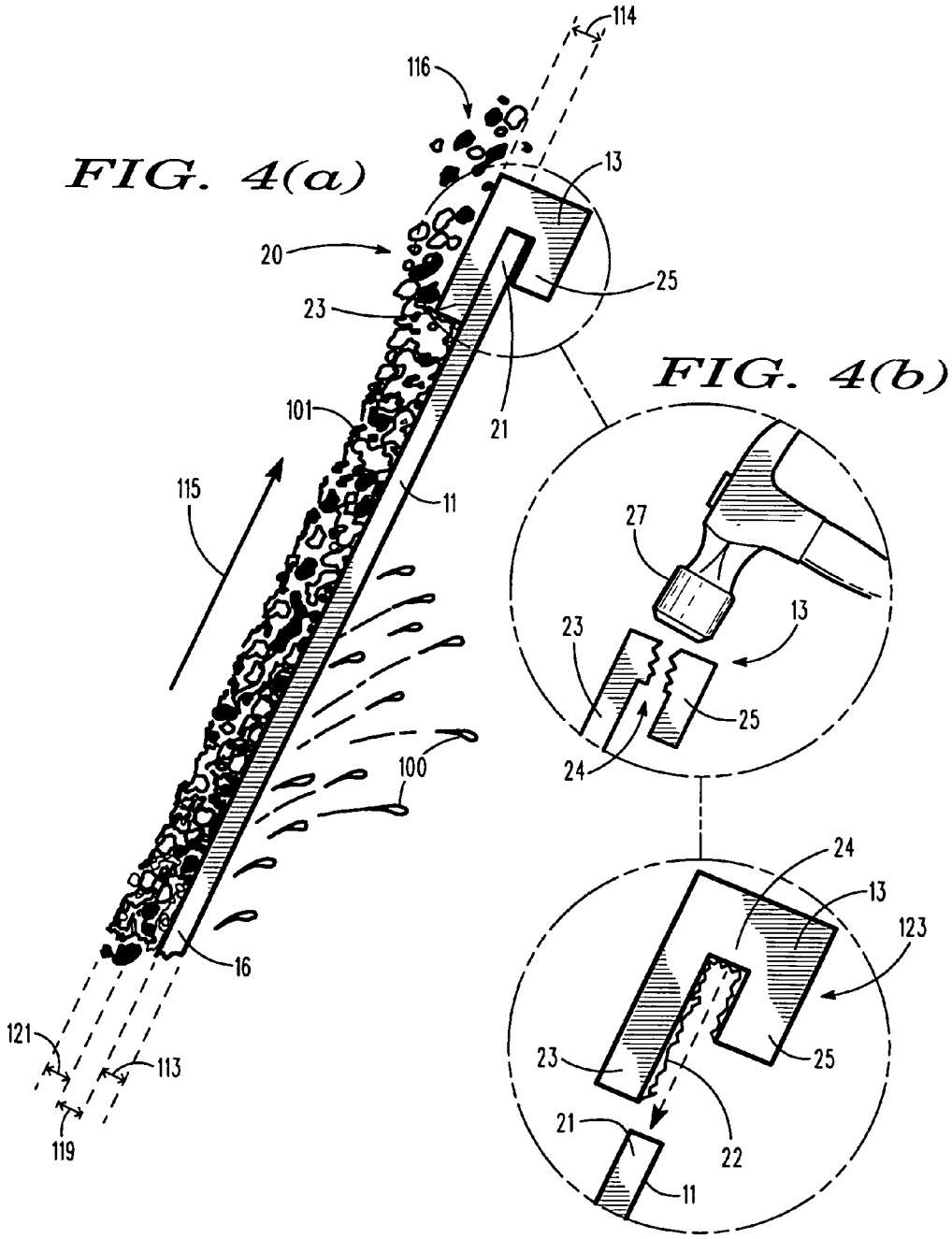
FIG. 4(*a*) is a fragmentary sectional side view of a portion of the separator screen with a dam segment outfitted upon the upper screen rim showing the flow direction of dammed/layered material and discharge of material adjacent the dam segment.

The separator screen 11 is sized and shaped to be received and supported by the basket 12. The separator screen 11 is also preferably formed from (stainless) steel and comprises a series of linearly extending accelerator bars 16, which bars are preferably welded parallel to one another such that the welds run parallel (not specifically illustrated). The parallel bars 16 provide sufficiently broad spacing for passing escaping moisture 100 (under centrifugal force), but sufficiently narrow spacing for preventing escape of large(r) particulate matter 101 as generally depicted in FIG. 4(*a*).

The separator screen 11 preferably comprising an inlet screen end as at 19, an outlet screen end as at 20, and a screen rim as at 21. The outlet screen end 20 is essentially defined by the screen rim 21, which rim 21 is circular as generally depicted in the various figures. The dam segments 13 are preferably adhesively attached to the rim 21 as generally depicted in FIG. 4(*c*) in which figure the adhesive means are referenced at 22.

Each dam segment 13 is preferably constructed from aluminous ceramic material (having high wear-resistance and impact-breakability) and is approximately J-shaped or hook-shaped when viewed from a side view or transversely. The dam segments 13 thus preferably comprise a frontal dam portion as at 23, an intermediate channel portion (or rim seat) as at 24, and a rear channel-defining portion 25. The channel portion 24 receives the rim 21. When the series of dam segments 13 are arranged and attached in a circular manner side-by-side atop or upon the rim 21, the dam portions 23 and channel-defining portions 25 extend toward the inlet screen end 19. In the preferred embodiment the dam portions 23 are of a relatively greater length than the channel-defining portions 25.

In other words, the structural relationship may be defined such that the dam segments 13 each comprise a radially inner leg (as at 23) and a radially outer leg (as at 25), which inner and outer legs 23 and 25 extend towards the narrow end of the basket assembly 10 (or hypothetical apex of the frustoconical screen 11) such that the legs 23 and 25 being in parallel or spaced relation to one another with the radially inner legs 23 being engaged on the inner side of the basket or screen 11 and with the radially outer legs 25 engaged on the outer side of the basket assembly 10 or screen 11.

Figure 8:
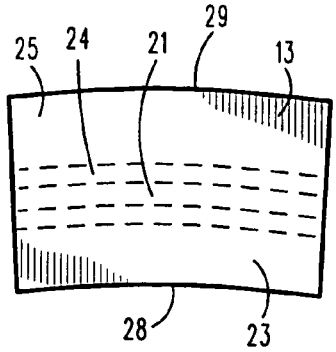
FIG. 8 is a top diagrammatic depiction of an alternative dam segment having a curved channel portion as arranged atop a separator screen rim, which rim has a radius of rim curvature substantially equal in magnitude to the radius of channel curvature of the dam segment.

It should be noted that the leg segments as at 23 and 25 need not be parallel to one another. Further, the leg segments 23 and 25 may alternatively be curved such that the radii of the curves substantially match the radii of the rims 21 to which the dam segments 13 attach. A general demonstration of this feature is depicted in FIG. 8, which shows a curved channel 24 intermediate a curved inward or inner edge 28 and a curved outer edge 29.

Figure 2A:
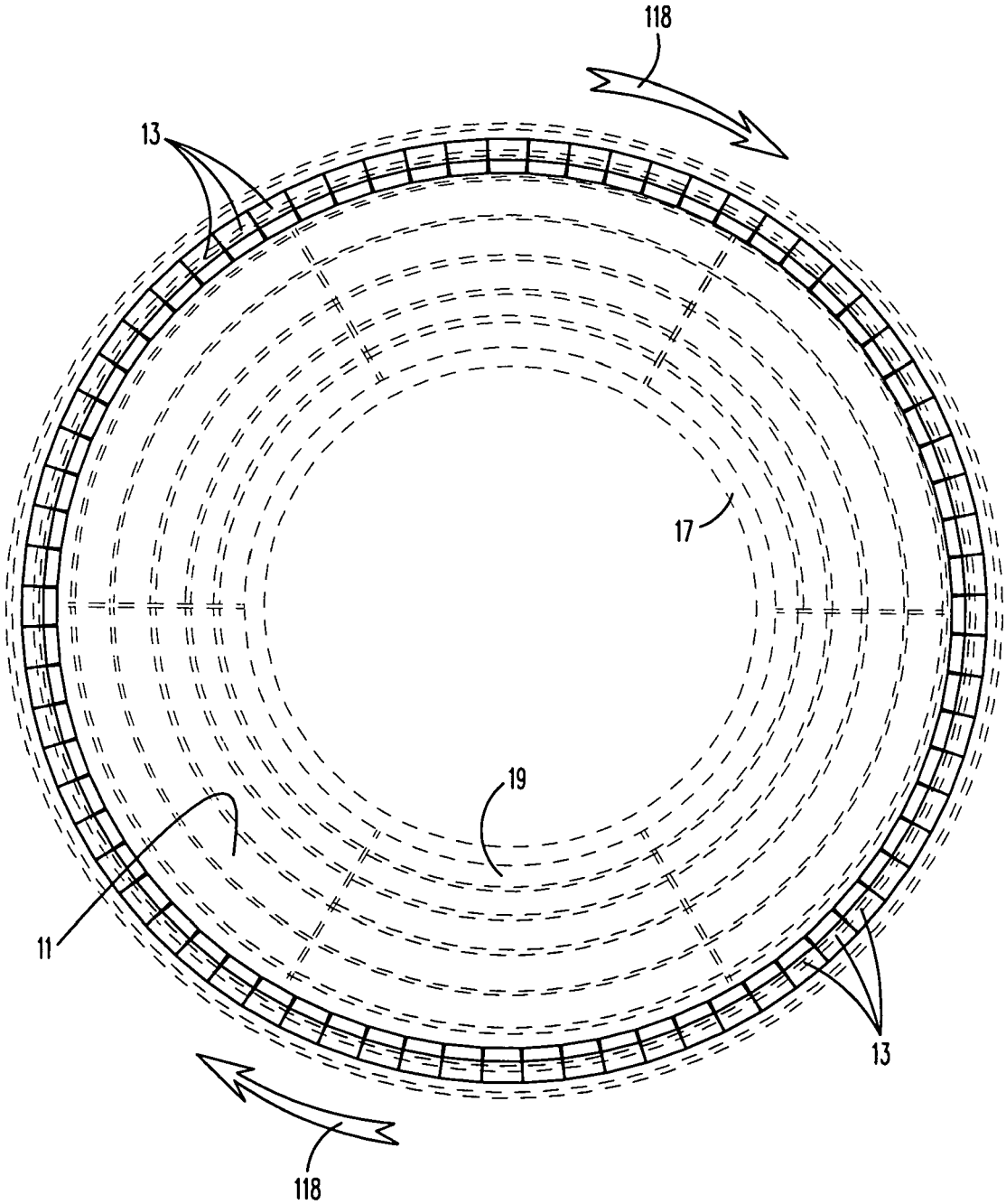
FIG. 2(*a*) is a top view of an empty spinning basket assembly according to the present invention showing a second series of dam segments arranged in side-by-side relation upon the separator screen rim of the basket assembly, the series of dam segments forming a complete circle.
Figure 2B:
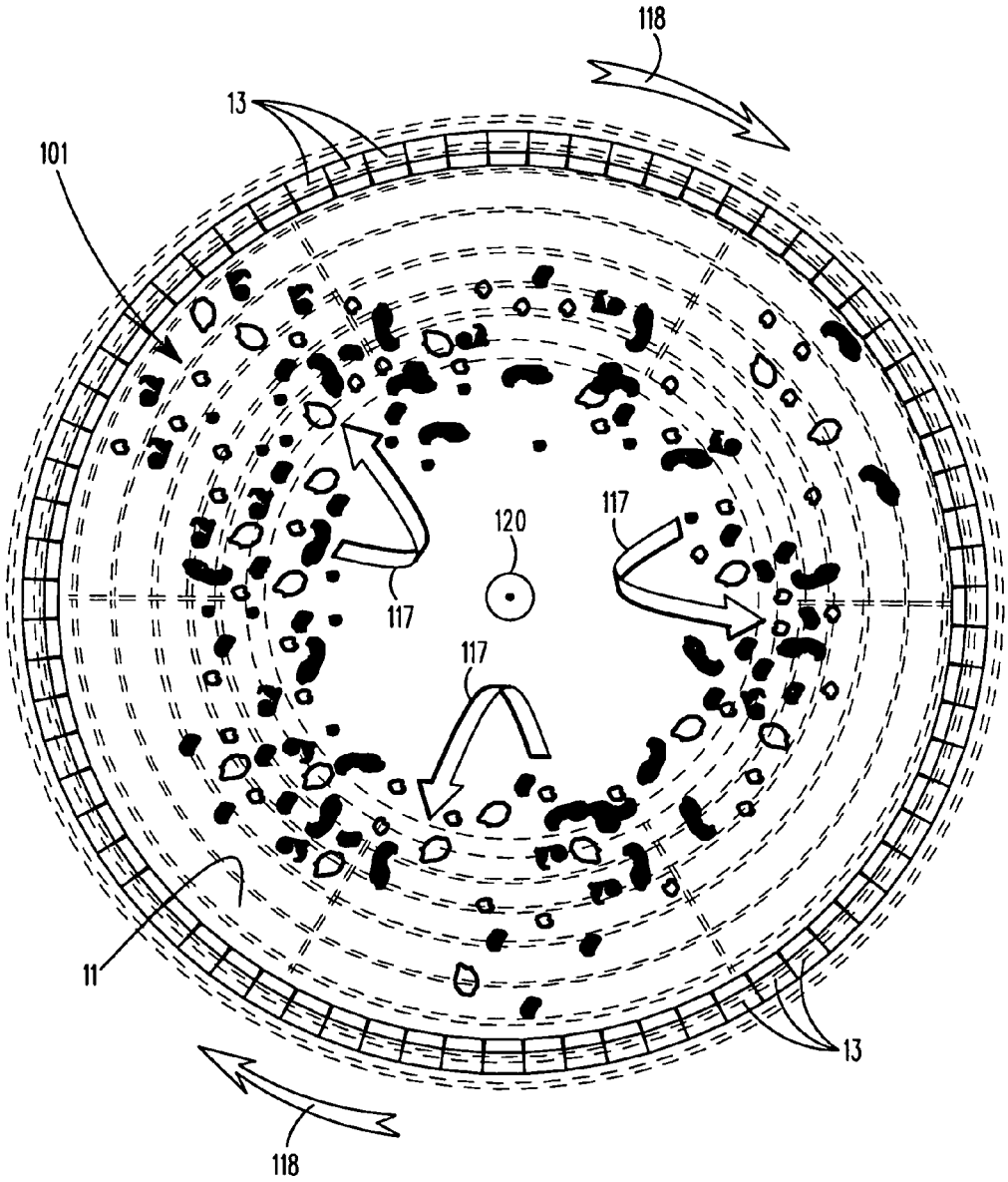
Figure 2C:
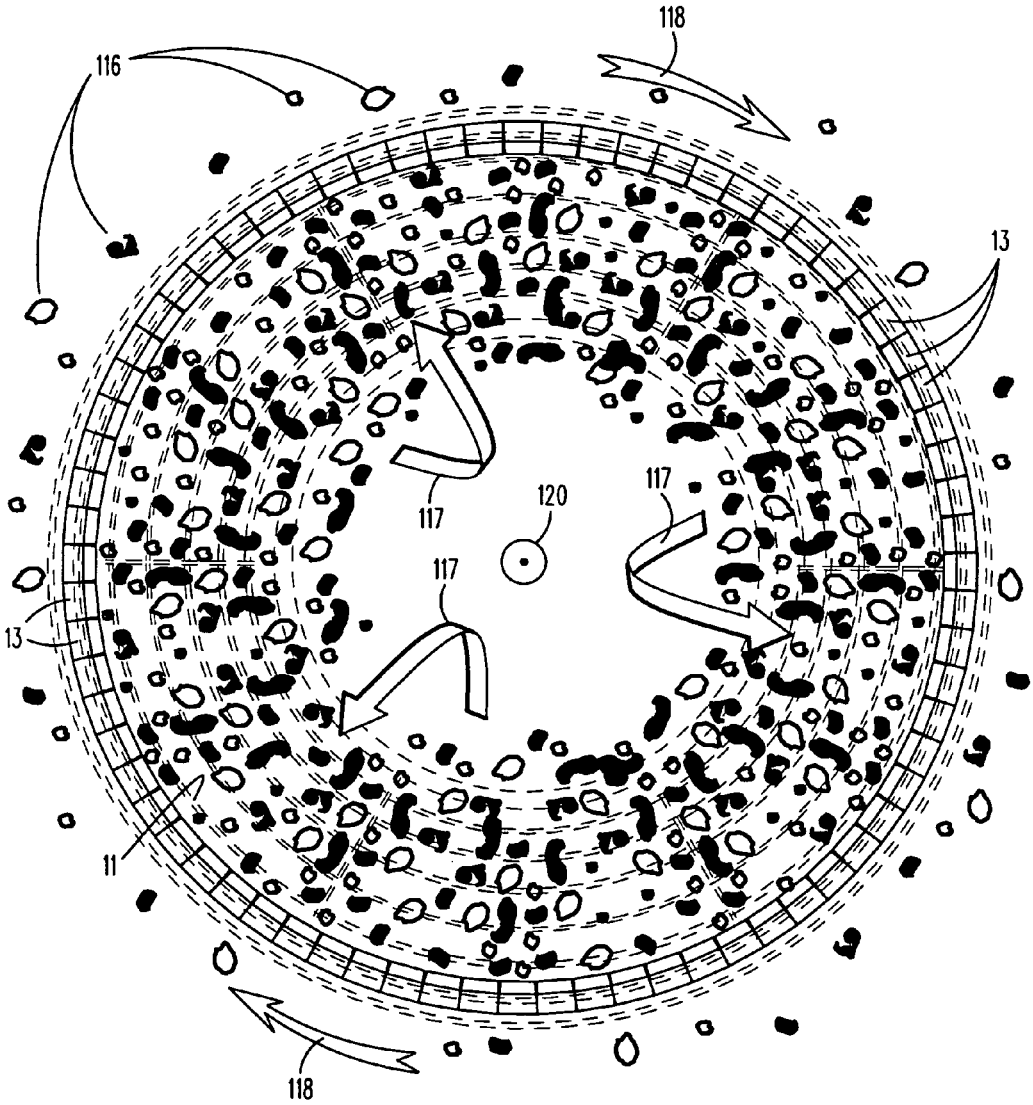

In this last regard, it is contemplated that the dam segments could conceivably be formed so as to form ¼ circle or ½ circle segments. However, in this type of scenario, the dam segments would have to be tailored to the exact rim dimensions, and is thus less preferred as compared to the relatively rectangular and short length dam segments 13. FIG. 2(*a*), for example, shows a series of seventy-two (72) dam segments 13 arranged about the circumference of the rim 21. Preferably, the dam segments 13 will comprise certain dimensions so as to allow a "one-size-fits all" type of arrangement, there being specific provision made, perhaps for the last dam segment 13, the length of which may need to be tailored to fit the final segment gap.

Figures 5A, 5B, 5C, 5D:
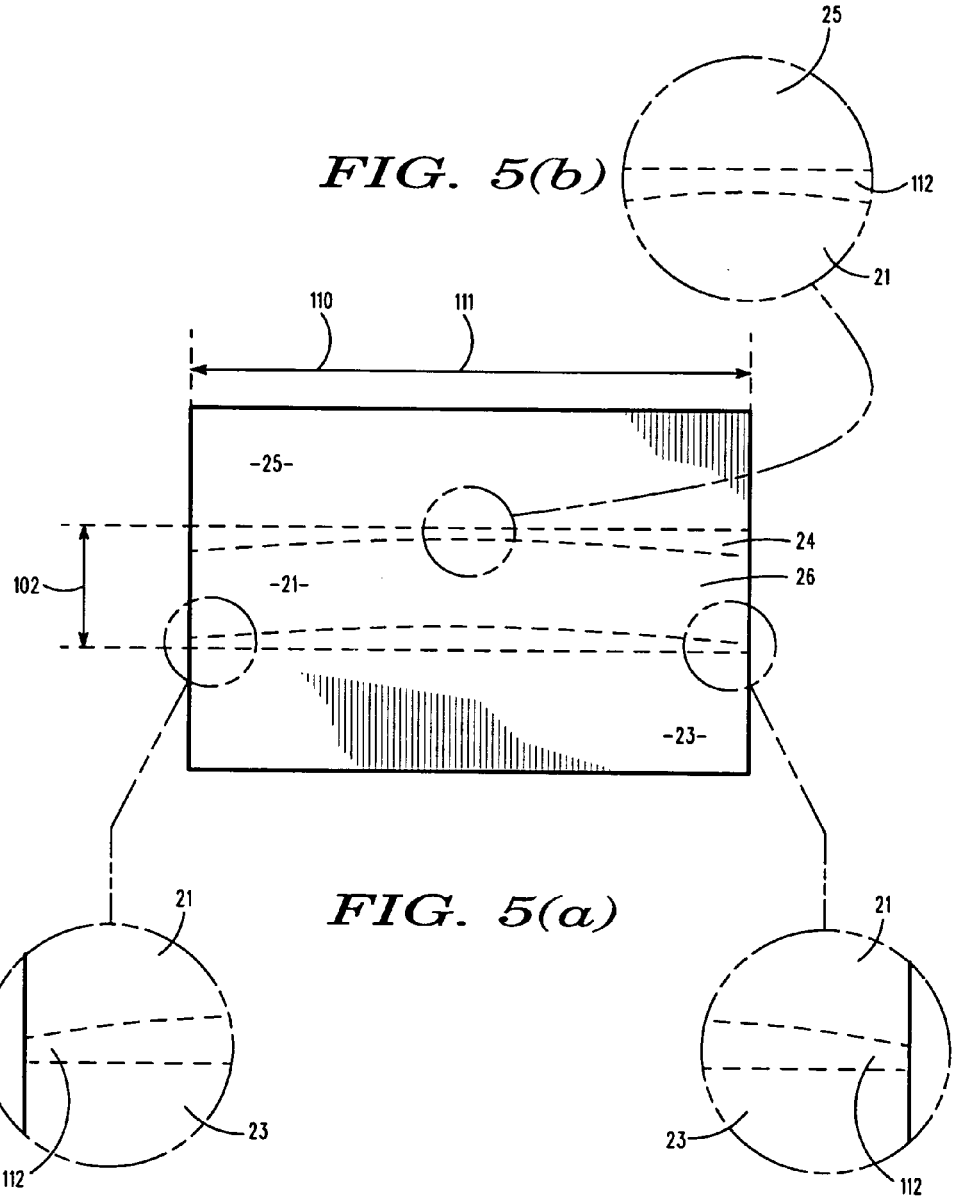
FIG. 5(*a*) is an enlarged top view of a dam segment showing a hidden channel portion thereof in broken lines and an arc length portion of a separator screen rim hidden by the dam segment, which hidden arc length portion is shown in broken lines.
Figure 7:
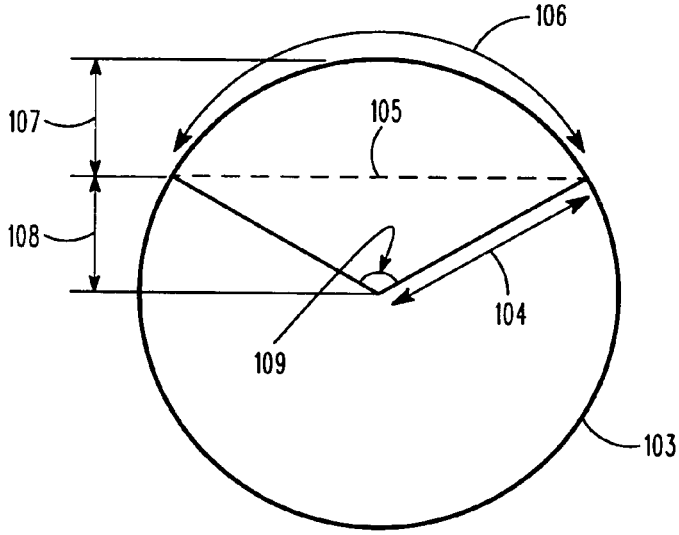
FIG. 7 is a circle with a certain radius and highlighting a circle segment with a chord length, an arc length, a segment height, and a triangular portion height.

Referring to FIG. 5(*a*), it will be seen that the dam segment(s) 13 will have a (substantially uniform) segment length as at 110 and that the channel portion(s) 24 of the dam segment(s) 13 each have a substantially uniform channel or seat width as referenced at 102. Referencing FIG. 7, it will be noted that a circle 103 with radius "R" (as referenced at 104) comprises a circular segment as defined by that area enclosed between the secant/chord as referenced at dashed line 105 and the arc as referenced at curved line 106, the endpoints of which coincide with those of the chord 105.

With "R" as the radius 104 of the circle 103; "c" the chord length; "s" the arc length (analogous to a rim segment length; "h" the height of the circular segment (as at 107); and "d" the height of the triangular portion (as at 108), it will be seen that the area of the circular segment is equal to the area of the circular sector minus the area of the triangular portion.

The radius "R" (as at 104) is:

$$R=h+d$$

The arc length "s" (as at 106) is:

$$s=R\theta, \text{ where } \theta \text{ (as at 109) is in radians.}$$

The area of the circular segment "A" is:

$$A=(R^2\div 2)(\theta-\sin\theta)$$

The chord length "c" (as at 105) is:

$$c=2R\sin(\theta/2)=R(2-2\cos)^{1/2}$$

The circular segment height "h" (as at 107) is:

$$h=R(1-\cos(\theta/2))$$

The angle "θ" (as at 109) is:

$$\theta=2\arccos d/R$$

The formulas are presented to illustrate to the reader that the channel or seat width 102 is greater in magnitude than the height 107 of the circular or rim segment 26, and that the segment length 110 is substantially equal to the chord length 105 of a rim segment 26 as at 111. It should be noted that the arc length of the rim segment 26 (or rim segment length) is slightly greater in magnitude than the chord length 111. The larger the radius of the rim 21, the less difference there is between the chord length and the arc length (or rim segment length). In other words, the larger the radius of the rim 21, the smaller the height 107 is of corresponding circular segment(s).

From an inspection of FIGS. 5(*a*) through 5(*d*), it will be seen that there are gaps 112 formed inside the boundary of the channel or seat portion 24 for receiving a corresponding rim segment 26 of the screen rim 21. It is contemplated that the number of dam segments 13 in the dam segment series used in combination with a given separator screen 11 may vary based on the segment length 110, channel width 102 and rim radius or diameter. The width of a typical accelerator bar 16 or bar width is on the order of ½ centimeter. It is contemplated that the bar width 113 will be maintained across applications and thus may be easily considered with any given application provided the other parameters.

Figure 6:
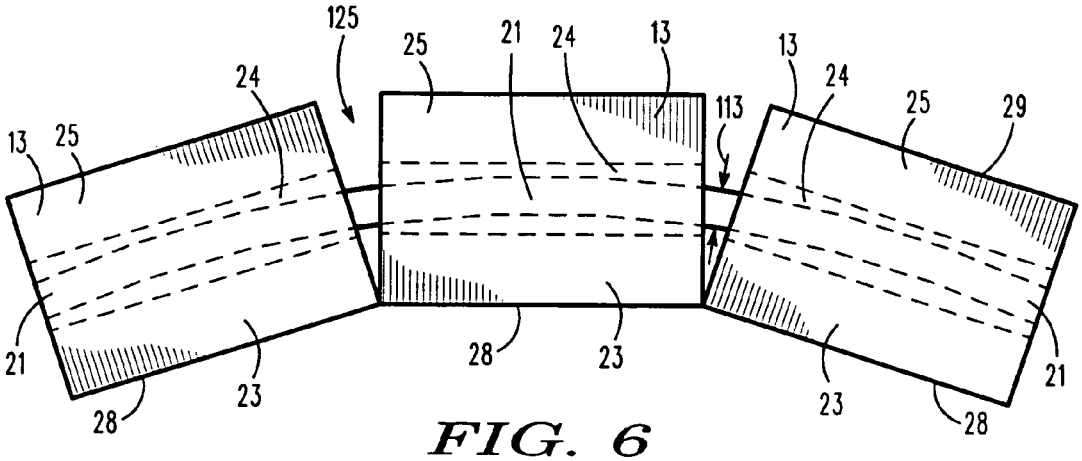
FIG. 6 is a top diagrammatic depiction of a series of three dam segments arranged in side-by-side relation atop a separator screen rim showing a relatively small radius of rim curvature to highlight gaps between rectangular dam segments as arranged upon a circular rim.

It will thus be seen that the dam segments 13 each have a given segment length as at 110 and that the channel or seat portions 24 each have (substantially uniform) channel or seat width as at 102. The rim 21 may be divided into a number of rim segments 26, which number of rim segments 26 is essentially equal to the number of dam segments 13 in the series of dam segments 13 per application. The chord lengths 111 of each rim segment 26 are substantially equal to the segment lengths (as at 110) and the height (as at 107) of the rim segments 26 (defining the outer boundary of a series of circular segments) are lesser in magnitude than the channel width 102. The complete circumference of the circular rim 21 is thus greater in magnitude than the sum of the segment lengths 110 as may be gleaned from an inspection of FIG. 6.

In said figure, it will be further seen that the dam segments 13 are attached to the rim in side-by-side relation such that when seen from a top plan view, the dam segments 13 are preferably rectangular relative to the circular rim 21. Given this geometrical relationship, the dam segments thereby define V-shaped gaps 125, which gaps ease removal of worn segments 13 since there is an effective gap (exaggerated in FIG. 6) adjacent the arranged segments 13 (except at the front or radially inward edge 28 of the segments) for structurally easing removal of the segments 13 as may be required.

It is further contemplated that the height of the dam or dam height (as at 114) can be increased or decreased to vary the bed depth according to particle size and material feed rate. The ceramic dam extends beyond the screen rim 21 in the direction of material flow as at 115. Discharging material 116 is typically discharged into a centrifuge discharge chute (not specifically illustrated).

Vector arrow(s) 120 in FIGS. 2(*b*) and 2(*c*) point out of the page in said figures, and attempt to depict the direction of input material in those views. As input material (as at 117) enters the spinning (as at 118) centrifuge or basket assembly 10, the material 101 comes into contact with the dam segments 13, which function to dam the matter or material 101 directed thereagainst as delivered thereto from the inlet screen end 19 along the bars 16 or screen 11.

The material 101 contacting the dam segments 13 tends to spread and layer more evenly so that the entire screen 11 is covered as generally depicted in FIG. 2(*c*). The segment-dammed material 101 then creates a first, screen-protecting layer as at 119. The dam segments 13 thus essentially function to more uniformly spread and layer material upon the separator screen 11 before the matter or material 101 exits the basket assembly 10 via the outlet end. The more uniformly spread and layered material 101, having provided a first, screen-protecting layer 114, effectively functions to reduce wear of the separator screen 11.

As earlier stated, the dam segments 13 are preferably constructed from a wear-resistant, impact-breakable ceramic material. In this regard, it is contemplated that when a select dam segment 13 becomes worn and requires replacement, it may be replaced by impacting it with an implement (such as a hammer 27) as diagrammatically depicted in FIG. 4(*b*). The impact-breakable dam segments 13 are thus impact-broken and replaced by removing the impact-broken portions of the select dam segment 13 from the rim 21 thereby leaving a segment gap site (as generally depicted at 122 in FIG. 3(*a*)), and attaching a replacement dam segment 13 (as at 123) to the rim 21 at the segment gap site 122.

Figure 3A:
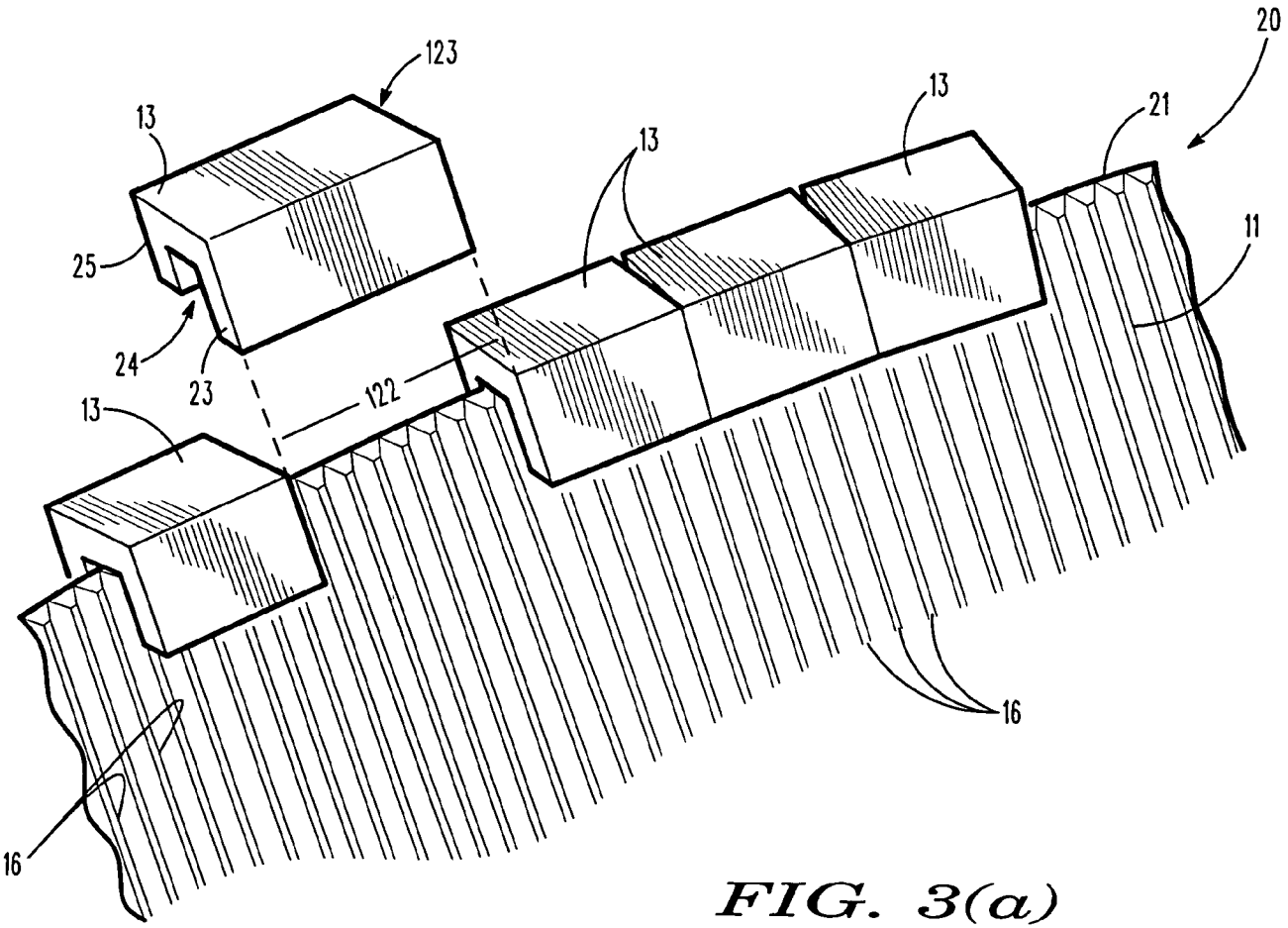
FIG. 3(*a*) is a fragmentary enlarged perspective view of a portion of the separator screen of the centrifugal basket assembly according to the present invention showing a series five dam segments being arranged in side-by-side relation upon the rim of the separator screen with a single dam segment being exploded from the rim.
Figure 3B:
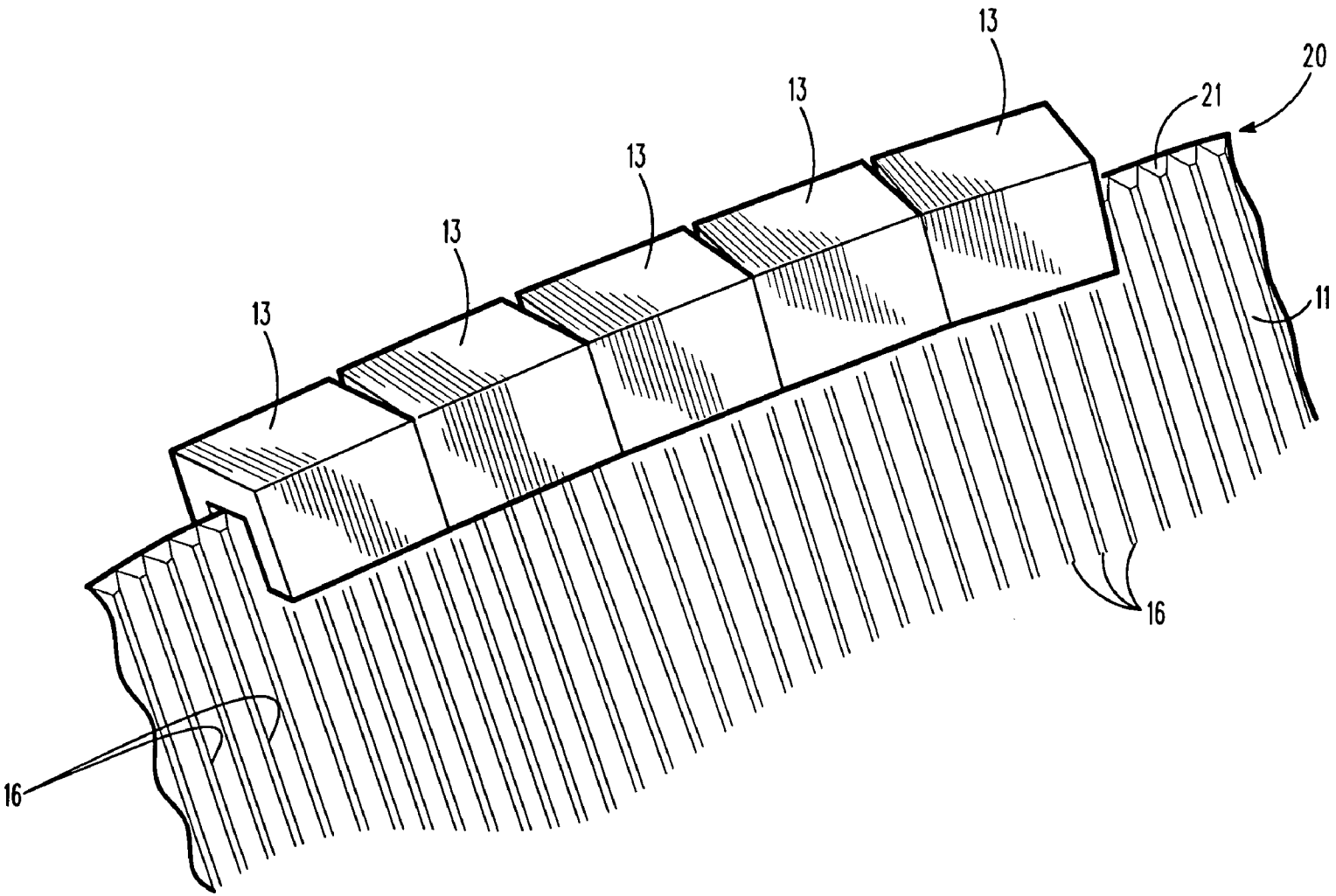

From a further consideration of FIG. 3(*a*), it should be understood that the diameters or radii of various rims 21 may differ. After nearly completely outfitting an entire rim periphery, a single non-uniformly dimensioned gap may be left open to be filled by a single final dam segment 13 as generally demonstrated in FIG. 3(*a*) at 122. In this regard, it is contemplated that the last dam segment 13 outfittable upon the rim 21 may be tailor made to properly fit the final gap. In other words, the final outfitted dam segment 13 may be formed (e.g. cut in length) to properly fill the final gap. It will thus be seen that the dam segments 13 may be either of a uniform or non-uniform length depending on the rim 21 specifications.

While the above descriptions contain much specificity, this specificity should not be construed as limiting the scope of the invention, but rather as an exemplification of the invention. For example, the invention may be said to essentially teach or disclose a separator screen arrangement for use with a centrifugal dryer, the separator screen arrangement comprising a separator screen and a series of dam segments outfitted upon the separator screen.

The separator screen comprises an inlet screen end and an outlet screen end, which outlet screen end is defined by a circular rim. The dam segments each preferably comprise a frontal dam portion, an intermediate channel portion (or rim-seating portion or seat portion), and a rear channel-defining portion. The channel or seat portions receive and or seat down and are attached to the rim, being arranged in a circular manner side-by-side about the rim such that the dam portions extend toward the inlet end.

The dam portions function to dam matter or material directed thereagainst from the inlet screen end so as to more uniformly spread and layer the matter or material upon the separator screen before the matter is discharged via the outlet end. The more uniformly spread and layered matter or material functions to reduce wear and tear of the separator screen by building up a protective first material layer upon the screen. Incoming material then impacts the first layer of material instead of the screen, thereby reducing wear.

Certain methodological steps or processes are believed further supported by the foregoing specifications and in this regard, it is contemplated that a certain material-drying method, a certain screen-protecting method, and a certain screen arrangement maintenance or repair methods are supported. In other words, it is contemplated that the present invention supports a method of drying matter in a centrifugal basket assembly; a method of preventing wear of a separator screen in a centrifugal basket assembly; and a method of maintaining a separator screen arrangement of a basket assembly.

It is contemplated that the material drying method may preferably comprise the steps of initially outfitting a basket assembly with series of dam segments, the dam segments being outfitted upon a circular outlet portion of the basket assembly. The basket assembly may then be rotated about an axis of rotation (along which vector 120 extends) so as to create a centrifugal basket assembly.

Matter is then directed through an inlet portion of the centrifugal basket assembly and into the dam segments along a separator screen of the basket assembly. The matter upon the separator screen is then dammed via the dam segments thereby more uniformly spreading the matter upon the separator screen. The spread matter is then dried by directing moisture through the separator screen away from the spread matter.

The dam segments are preferably outfitted upon the circular outlet portion in side-by-side relation so as to eliminate dam segment gaps, which arrangement is believed to enhance spreading uniformity of the spread matter. The basket assembly and/or screen assembly is preferably frustoconical such that the matter is slope-directed into the dam segments along the separator screen. After drying the matter in said manner, it is contemplated that the method may further comprise the step of directing matter away from the basket assembly.

The method for preventing wear and tear of a centrifugal separator screen may be said to comprise the steps of initially outfitting a separator screen with series of dam segments, which dam segments are again outfitted upon a circular outlet portion of the separator screen. The separator screen may then be rotated about an axis of rotation so as to create a centrifugal separator screen. A first set of matter or material may then be directed through an inlet portion of the centrifugal separator screen and into the dam segments along the centrifugal separator screen.

The first set of material(s) is then dammed upon the separator screen via the dam segments. The first set of material is spread upon the separator screen via said damming action, and a second set of material is directed through the inlet portion of the separator screen. The second set of material (as at 121) effectively becomes layered upon the first set of material (as at 119), and the first set of material thereby provides a screen-protecting layer. The first and second sets of material may then be dried by directing moisture through the separator screen away from the spread matter as the screen-protecting layer functions to prevent wear and tear of the centrifugal separator screen.

From the foregoing, it will be observed that numerous variations and modifications of the underlying inventive subject matter may be effected without departing from the spirit and scope of the invention. Further, certain material drying and screen protecting methodologies are supported by the basic understanding of the inventive subject matter surrounding the segmented damming feature of this centrifugal basket assembly. Thus, it is to be understood that no limitation with respect to the specific apparatus and/or methodologies illustrated herein is intended or should be inferred. It is, of course, intended to cover by the appended claims all such modifications as fall within the scope of the claims.

I claim:

1. A method for preventing wear of a centrifugal separator screen, the method comprising the steps of:

outfitting a separator screen with a series of dam segments, the dam segments being outfitted upon a circular outlet portion of the separator screen;

rotating the separator screen about an axis of rotation so as to create a centrifugal separator screen;

directing a first set of material through an inlet portion of the centrifugal separator screen;

directing the first set of material into the dam segments along the centrifugal separator screen;

damming the first set of material upon the centrifugal separator screen via the dam segments;

spreading the first set of material upon the centrifugal separator screen via said damming action;

directing a second set of material through the inlet portion of the centrifugal separator screen; and layering the second set of material upon the first set of material, the first set of material thereby providing a screen-protecting layer for preventing wear of the centrifugal separator screen.

2. The method of claim 1 wherein the dam segments are outfitted upon the circular outlet portion in side-by-side relation so as to eliminate dam segment gaps, the dam segments being so outfitted so as to enhance spreading uniformity of the first set of material.

3. The method of claim 1 wherein the centrifugal separator screen is frustoconical, the first set of material being slope-directed into the dam segments along the centrifugal separator screen.

4. The method of claim 1 wherein the first and second sets of material are dried by directing moisture through the centrifugal separator screen away from the spread first and second sets of material.

5. A method for preventing wear of a centrifugal separator screen, the method comprising the steps of:

outfitting a centrifugal separator screen with a series of dam segments, the dam segments being outfitted upon an outlet portion of the centrifugal separator screen;

directing a first set of material into the dam segments along the centrifugal separator screen via an inlet portion of the centrifugal separator screen;

damming the first set of material upon the centrifugal separator screen via the dam segments;

spreading the first set of material upon the centrifugal separator screen via said damming action;

directing a second set of material through the inlet portion of the centrifugal separator screen; and layering the second set of material upon the first set of material, the first set of material thereby providing a screen-protecting layer for preventing wear of the centrifugal separator screen.

6. The method of claim 5 wherein the dam segments are outfitted upon the outlet portion in side-by-side relation so as to eliminate dam segment gaps, the dam segments being so outfitted so as to enhance spreading uniformity of the first set of material.

7. The method of claim 5 wherein the centrifugal separator screen is frustoconical, the first set of material being slope-directed into the dam segments along the centrifugal separator screen.

8. The method of claim 5 wherein the first and second sets of material are dried by directing moisture through the centrifugal separator screen away from the first and second sets of material.

9. A method for preventing wear of a centrifugal separator screen, the method comprising the steps of:

outfitting a centrifugal separator screen with a series of dam segments, the dam segments being outfitted upon an outlet portion of the centrifugal separator screen;

directing a first set of material into the dam segments along the centrifugal separator screen;

damming the first set of material upon the centrifugal separator screen via the darn segments;

spreading the first set of material upon the centrifugal separator screen via said damming action; and layering a second set of material upon the spread first set of material, the first set of material thereby providing a screen-protecting layer for preventing wear of the centrifugal separator screen.

10. The method of claim 9 wherein the dam segments are outfitted upon the outlet portion in side-by-side relation so as to eliminate dam segment gaps, the dam segments being so outfitted so as to enhance spreading uniformity of the first set of material.

11. The method of claim 9 wherein the centrifugal separator screen is frustoconical, the first set of material being slope-directed into the dam segments along the centrifugal separator screen.

12. The method of claim 9 wherein the first and second sets of material are dried by directing moisture through the centrifugal separator screen away from the spread first and layered second sets of material.

* * * * *